US008276352B2

(12) United States Patent
Moessnang et al.

(10) Patent No.: US 8,276,352 B2
(45) Date of Patent: Oct. 2, 2012

(54) PACKAGING MACHINE

(75) Inventors: Konrad Moessnang, Kempten (DE); Rainer Haering, Lauben (DE)

(73) Assignee: Multivac Sepp Haggenmueller GmbH & Co. KG (DE)

( * ) Notice: Subject to any disclaimer, the term of this patent is extended or adjusted under 35 U.S.C. 154(b) by 90 days.

(21) Appl. No.: 12/378,623

(22) Filed: Feb. 18, 2009

(65) Prior Publication Data

US 2009/0241469 A1 Oct. 1, 2009

(30) Foreign Application Priority Data

Mar. 26, 2008 (DE) ..... 10 2008 015 689

(51) Int. Cl.
*B31B 31/04* (2006.01)

(52) U.S. Cl. ..... 53/510; 53/432

(58) Field of Classification Search ..... 53/428, 53/432, 111 R, 510, 511, 512
See application file for complete search history.

(56) References Cited

U.S. PATENT DOCUMENTS

| | | | | |
|---|---|---|---|---|
| 3,397,508 | A | 8/1968 | Stroop | |
| 3,818,574 | A | 6/1974 | Reid et al. | |
| 5,465,557 | A * | 11/1995 | Harte | 53/510 |
| 5,822,956 | A * | 10/1998 | Liechti et al. | 53/510 |
| 6,050,446 | A * | 4/2000 | Lei et al. | 220/819 |
| 6,454,115 | B1 * | 9/2002 | Allasia | 220/4.23 |

FOREIGN PATENT DOCUMENTS

| | | | |
|---|---|---|---|
| DE | 102 38 482 | | 12/2003 |
| DE | 102006006220 | A1 | 8/2007 |
| WO | 9529846 | A1 | 11/1995 |
| WO | WO-01/94209 | | 12/2001 |
| WO | 2007090571 | A2 | 8/2007 |

OTHER PUBLICATIONS

"Lid-Cleaning-Instructions" for WEBOMATIC double chamber machines, 1 Page.

European Patent Office Communication Dated Jan. 3, 2012, Applicant Multivac Sepp Haggenmueller GmbH & Co. KG, Application No. 08020942.2-2308/2105838, including the Opposition filed by Webomatic Maschinenfabrik GmbH & Dokumente, dated Feb. 24, 2012, 16 Pages. (Partial translation provided).

European Patent Office Communication Dated Mar. 13, 2012, Applicant Multivac Sepp Haggenmueller GmbH & Co., KG, Application No. 08020942.2-2308/2105838, including the Opposition filed by GEA CFS GmbH & Dokumente on Feb. 24, 2012, 11 Pages.

European Patent Office Communication Dated Mar. 13, 2012, Applicant Multivac Sepp Haggenmueller GmbH & Co. KG, Application No. 08020942.2-2308/2105383, including Opposition filed by GEA CFS GmbH on Feb. 24, 2012 (with English translation), and associated Attachments B1 to B12 and Cl to C12, 112 Pages.

* cited by examiner

*Primary Examiner* — Christopher Harmon
(74) *Attorney, Agent, or Firm* — Brooks Kushman P.C.

(57) ABSTRACT

A packaging machine comprises a chamber (4) having a cover (5), wherein the cover (5) which is liftable from a lowered position in which a chamber (4) is closed into a lifted position, in which a chamber (4) is opened. It is the object of the device or the method to improve the ergonomic accessibility and the visibility of the cover inside of a vacuum chamber of a packaging machine during maintenance, repair or cleaning work. For this purpose, the cover (5) is pivotable in the lifted position.

20 Claims, 3 Drawing Sheets

PACKAGING MACHINE

The present invention refers to a packaging machine, in particular to a chamber band machine.

In the field of packaging machines heavy requirements are made concerning the cleanability and the ease of servicing. In automated vacuum packaging machines, for example in chamber band machines in the upper range of performance, the chamber cover of the vacuum chamber can only be moved vertically, wherein it is difficult for cleaning or service stuff to clean the cover inside and to accomplish maintenance or repair work. Only a ca. 300 mm wide gap is normally available between the machine frame and the bottom edge of the cover. Due to this limited accessibility the operation can only be accomplished in a limited way or with higher workload. The accessibility and the visibility of the cover inside during maintenance, repair or cleaning work is hindered. From the ergonomic point of view this work causes high physical stress for the service technician or the cleaning stuff.

The object of the present invention is to provide a packaging machine which improves the ergonomic accessibility and the visibility of the cover inside of a vacuum chamber of a packaging machine for maintenance, repair or cleaning work.

The problem is solved by a packaging machine according to claim 1. Further developments of the invention are indicated in the respective dependent claims.

Due to the pivotability of the cover according to the invention the ergonomic accessibility and the visibility of the cover inside is improved. Thus, maintenance, repair or cleaning work can be accomplished by a service technician or cleaning staff standing in front of the machine. In particular this is essential in the field of food packaging or packaging of medical sterile goods, because strict hygienic regulations by law have to be met hereby.

Figure 1:
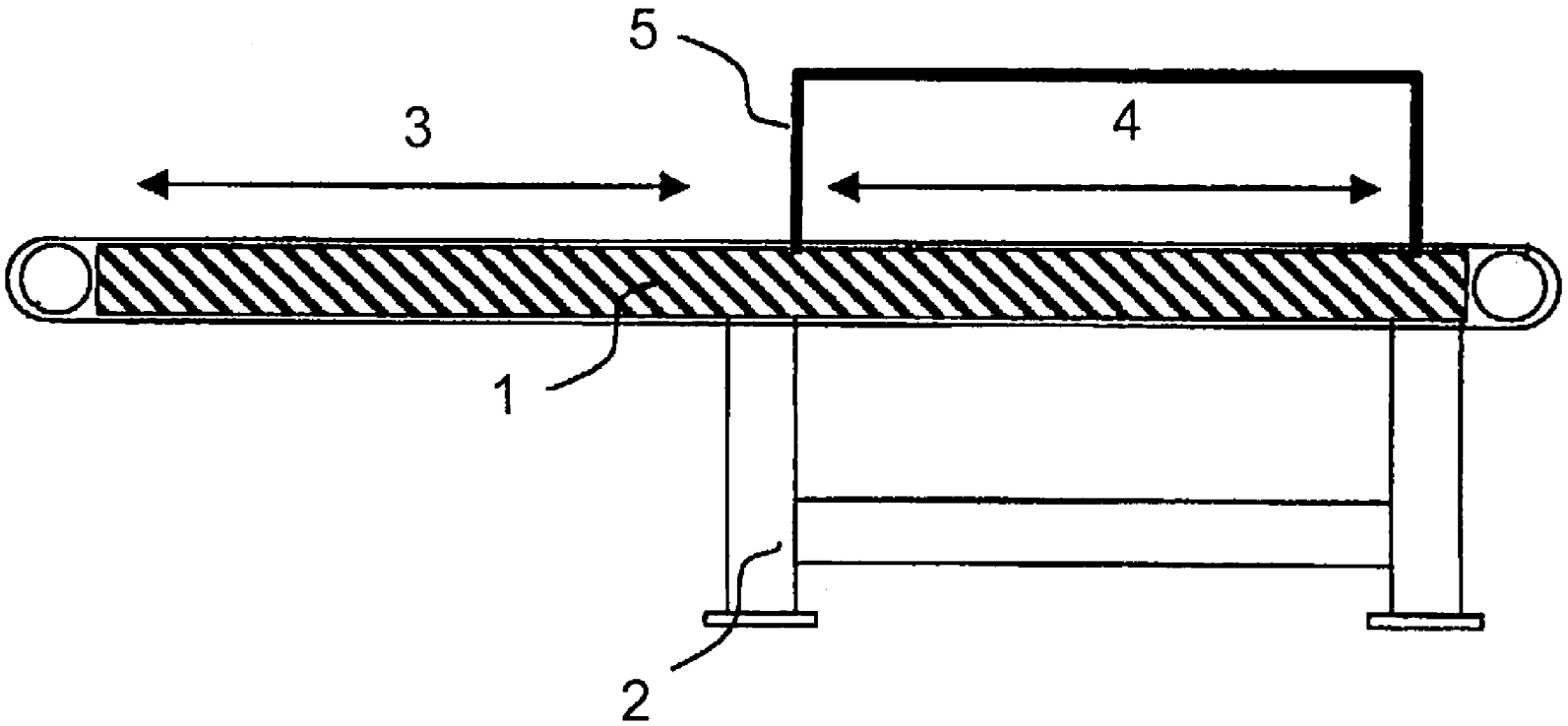
Figure 2B:
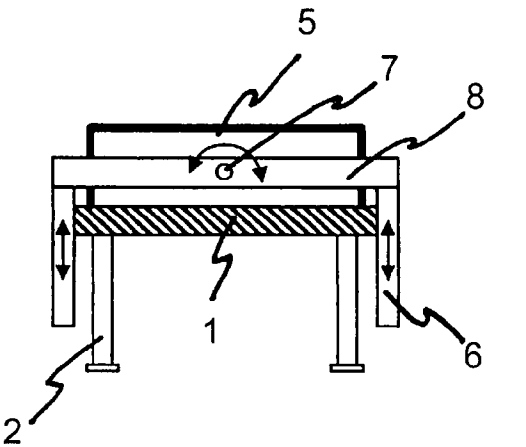
Figure 3B:
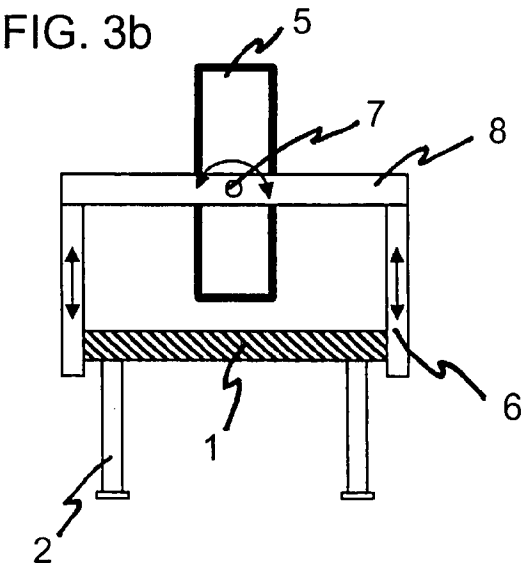
Figure 2A:
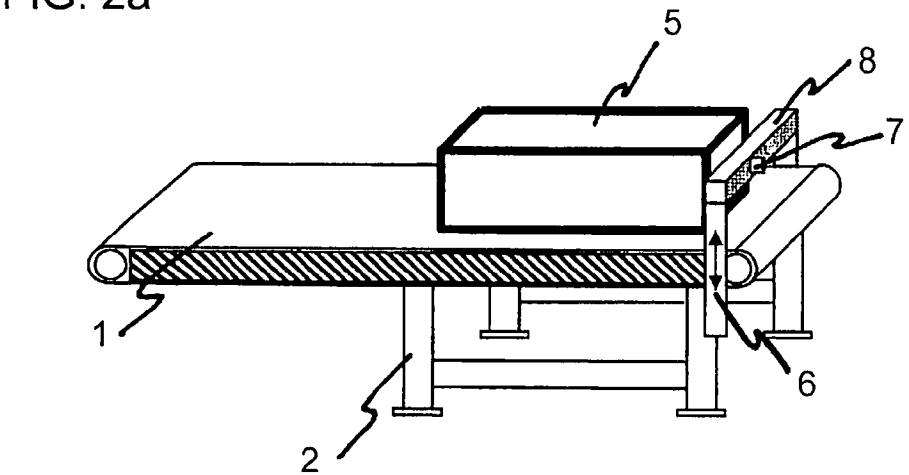
Figure 3A:
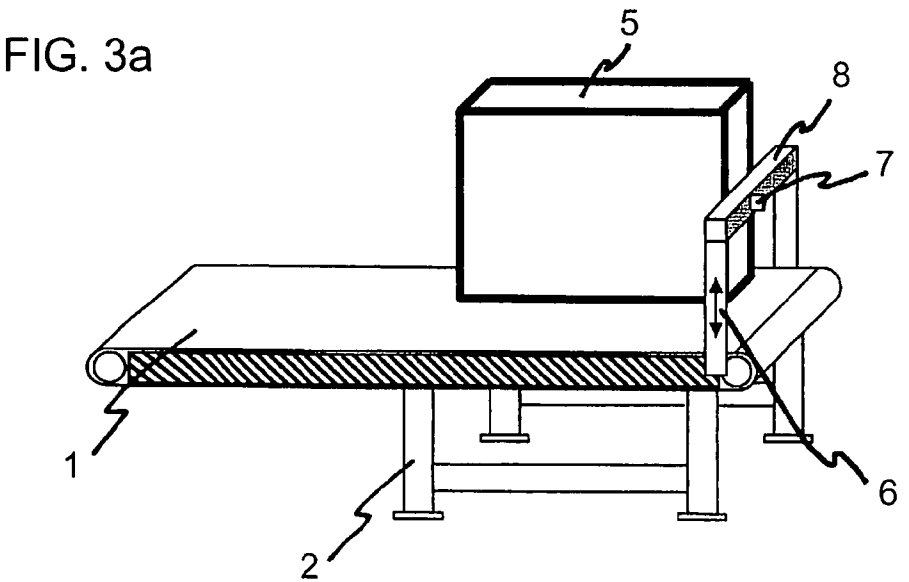
Figure 5:
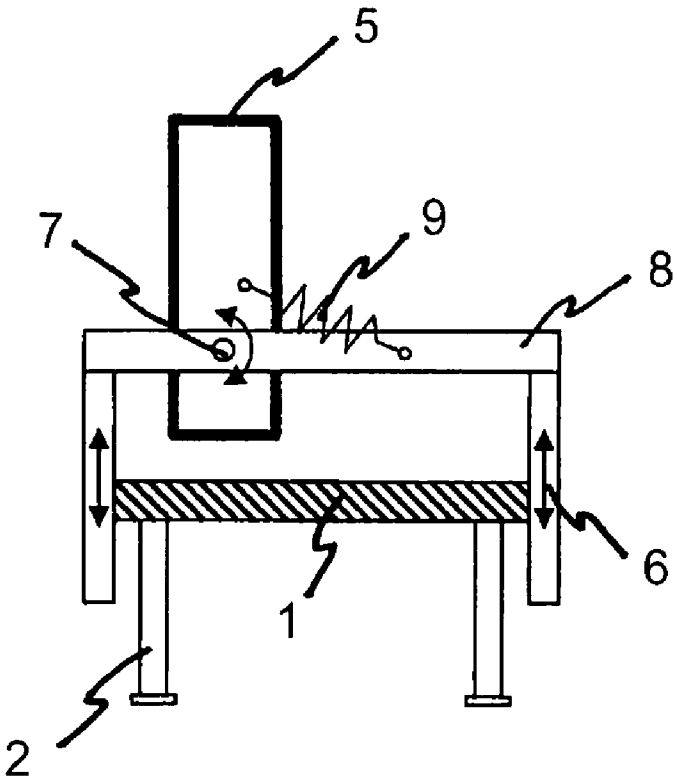
Figure 4:
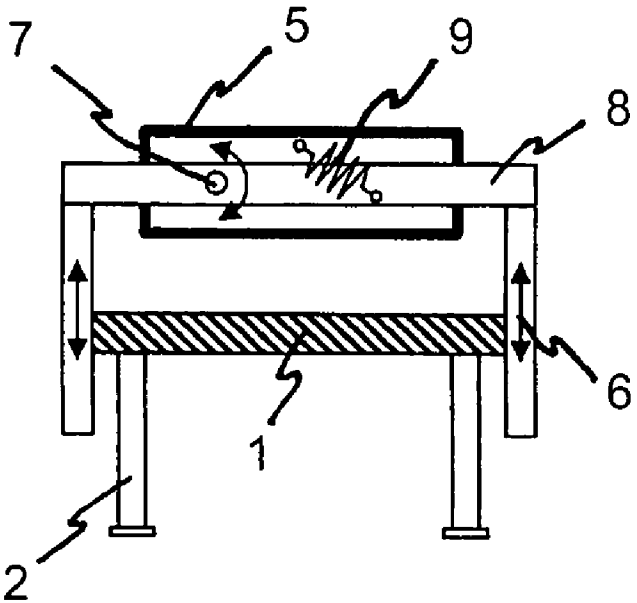

Further features and advantages of the invention are disclosed in the description of embodiments together with the enclosed drawings. The figures show:

FIG. 1 a schematic view of a chamber band machine;

FIG. 2*a* a schematic perspective view of a chamber band machine having a cover closed according to the first embodiment;

FIG. 2*b* a schematic front view of the chamber band machine having the cover closed according to a first embodiment;

FIG. 3*a* a schematic perspective view of the chamber band machine having the cover opened according to the first embodiment;

FIG. 3*b* a schematic front view of the chamber band machine having the cover opened according to the first embodiment;

FIG. 4 a schematic front view of the chamber band machine having the cover closed according to the second embodiment;

FIG. 5 a schematic front view of the chamber band machine having the cover opened according to the second embodiment.

In the following, a first embodiment of the present invention is described with reference to FIGS. 1, 2*a*, 2*b*, 3*a* and 3*b* using a chamber band machine as example. In the present embodiment the chamber band machine is formed as an automated chamber band machine.

FIG. 1 shows a schematic view of a chamber band machine having a conveyor band 1, a frame 2, a deposit area 3, a vacuum chamber 4 and a cover 5. The chamber 4 is formed by the cover 5 together with a part of the band conveyor 1, wherein the cover 5 is operated motorically, pneumatically or hydraulically, and opens automatically or controlled by force actuation or can be opened manually, to receive for instance bags which are to be evacuated and sealed, respectively and which are fed automatically by the band conveyor 2, and wherein the cover 5 automatically closes to form the chamber 4.

The cover 5 is composed of one top surface, two side surfaces and two front surfaces. In FIG. 1 the cover 5 is in its horizontal operation position or in its lowered position relative to the band conveyor 1, wherein the top surface of the cover 5 is aligned in parallel to the band conveyor 1. In this position the chamber 4 is closed.

FIG. 2*a, b* show the chamber band machine in a perspective view and in a front view. The cover 5 is in its horizontal operation position. A lifting device 6 is provided, which enables a lifting motion of the cover 5 in a vertical direction, i.e. orthogonal to the band conveyor 1, into a lifted position, in which the chamber 4 is opened. The lifting device 6 can be a linear guiding for instance, which is fixed on both sides of the band conveyor 1 at the frame 2. The movable parts of the linear guiding, which shall realize the vertical lifting of the cover 5, are connected to each other by a cross-member 8. The cover 5 is articulated with this cross-member 8, by means of a joint 7, which is positioned there in center. Thus, the cover 5 can accomplish a rotational movement about the joint axis in addition to the vertical translation movement. The rotation axis runs through the centers of area of both front surfaces of the cover 5 to ensure a free moving pivoting of the cover 5. It is also possible to connect the cover 5 to the joint 7 in such a manner, that the rotation axis runs through the center of mass of the cover 5 and runs parallel to both under edges of the side surfaces.

FIGS. 3*a, b* show the chamber band machine in a perspective view and in a front view. The cover 5 is in its vertical maintenance, repair or cleaning position i.e. in a lifted and pivoted position, which is designated as maintenance position in the following. The side surfaces of the cover 5 are parallel to the band conveyor 1 in this position. One half of the front surfaces and the side surfaces of the cover 5 is above and one half below the cross-member 8, respectively.

In operation the cover 5 is brought from its operation position (see FIGS. 2*a, b*) to the maintenance position, to accomplish maintenance, repair or cleaning work within the cover. Therefore, the cover 5 is first moved translational upwards in a vertical direction by the lifting device 6. Because of the articulated connection of the cover 5 to the cross-member 8, by means of the joint 7, the cover 5 can be pivoted into a vertical maintenance position after this lifting movement. In this position the cover inside is accessible or visible in an optimal way. To transfer the cover 5 from the maintenance position back to the operation position, the cover 5 is re-pivoted about its rotation axis and is thereafter brought in its operation position by the lifting device 6.

FIGS. 4, 5 show a second embodiment of the present invention. The joint 7 is fixed excentrically on the cross-member 8. Correspondingly, the cover 5 is also connected excentrically to the joint 7 to ensure a correct position of the cover 5 above the band conveyor 1. In FIG. 4 the cover 5 is located in a lifted position, after the lifting movement, but still previous to the pivoting movement of the cover 5. In FIG. 5 the cover 5 is arranged in its maintenance position. By the excentric fixing of the cover 5, only a small lifting movement of the lifting device 6 is needed to move the cover 5 from its operation position into its maintenance position, because most of the cover 5 extends above the cross-member 8.

Since the rotation or pivoting axis of the cover 5 does not run through its center of mass, an auxiliary device 9, in the form of a gas pressure spring or a pneumatic cylinder for instance, is provided to ensure an optimal handling and a free moving pivoting of the cover 5, respectively. One end of the auxiliary device 9 is attached to the cover 5, the other end is attached to the cross-member 8.

The form of the cover is not limited to the shown form. The cover also can have the form of a hollow half sphere for instance or any other form.

The invention is further not either limited to the use in chamber band machines. It is also applicable in chamber machines without a conveyor band or for example in a chamber of an working station of a vacuum packing machine.

The invention claimed is:

1. A packaging machine comprising:

a chamber comprising a liftable, pivotable cover, the chamber being closed when the cover is in a lowered position and open when the cover is in a lifted position, the cover being liftable from the lowered position to the lifted position by a vertical translation movement, and the cover being pivotable in the lifted position;

wherein the packaging machine is structured and arranged as a chamber band machine having the cover and a band conveyor, in which the cover together with a part of the band conveyor form the chamber, and the packaging machine further comprises a cross-member having first and second ends that are supported on opposite sides of the band conveyor, and wherein the cover is pivotally connected to the cross-member.

2. The packaging machine according to claim 1, wherein the cross-member includes a joint about which the cover is pivotable.

3. The packaging machine according to claim 1, further comprising a lifting device to lift and lower the cover.

4. The packaging machine according to claim 2, wherein the cover has a center of mass and is connected to the joint in such a manner that a rotation axis of the joint runs through the center of mass of the cover.

5. The packaging machine according to claim 2, wherein the cover has a center of mass and is connected to the joint in such a manner that a rotation axis of the joint does not run through the center of mass of the cover.

6. The packaging machine according to claim 1, further comprising an auxiliary device to pivot the cover.

7. The packaging machine according to claim 6, wherein the auxiliary device comprises a spring and/or a pneumatic cylinder.

8. The packaging machine according to claim 1, wherein actuation of a force controls the lifting and/or pivoting of the cover.

9. The packaging machine of claim 1, wherein the band conveyor is disposed beneath the cover for conveying packages in a transport direction, and wherein the cover is pivotable about an axis that extends in the transport direction.

10. The packaging machine of claim 9, wherein the cross-member extends in a direction transverse to the transport direction, and the axis extends through the cross-member.

11. The packaging machine of claim 1, wherein the band conveyor is disposed beneath the cover for conveying packages, the cover has first and second side surfaces that extend vertically when the cover is in the lowered position, and the cover is pivotable to a position in which the side surfaces are parallel to the band conveyor when the cover is in the lifted position.

12. The packaging machine of claim 1, wherein the cover has first and second side surfaces that extend vertically when the cover is in the lowered position, and the cover is pivotable to a position in which the side surfaces are parallel to each other when the cover is in the lifted position.

13. A packaging machine comprising:

a band conveyor for conveying packages in a transport direction;

a cover that is vertically movable from a lowered position to a lifted position, wherein the cover and a part of the band conveyor form a chamber when the cover is in the lowered position;

a cross-member to which the cover is pivotally connected, the cross-member having first and second spaced apart ends that are supported on opposite sides of the band conveyor; and a lifting device associated with the cross-member and configured to vertically translate the cross-member to thereby vertically translate the cover from the lowered position to the lifted position;

wherein when the cover is in the lifted position, the cover is pivotable with respect to the cross-member about an axis that extends in the transport direction.

14. The packaging machine of claim 13, wherein the cross-member is non-rotatable and extends in a direction transverse to the transport direction.

15. The packaging machine of claim 13, wherein the cover has first and second side surfaces that extend vertically when the cover is in the lowered position, and the cover is pivotable to a position in which the side surfaces are parallel to the band conveyor when the cover is in the lifted position.

16. The packaging machine of claim 13, wherein the cover has a center of mass and the axis runs through the center of mass of the cover.

17. The packaging machine of claim 13, wherein the cover has a center of mass and the axis does not run through the center of mass of the cover.

18. The packaging machine of claim 1, wherein the cross-member is non-rotatable, and the first and second ends of the cross-member are supported to allow translational movement of the cross-member, wherein the cross-member translates upwardly with the cover when the cover moves from the lowered position to the lifted position, and the cover is pivotable with respect to the cross-member when the cover is in the lifted position.

19. A packaging machine comprising:

a chamber comprising a liftable, pivotable cover, the chamber being closed when the cover is in a lowered position and open when the cover is in a lifted position, the cover being liftable from the lowered position to the lifted position by a vertical translation movement, and the cover being pivotable in the lifted position; and a non-rotatable cross-member to which the cover is pivotally connected, the cross-member having first and second spaced apart ends that are supported on opposite sides of the chamber to allow translational movement of the cross-member;

wherein the cross-member is configured to translate upwardly with the cover when the cover moves from the lowered position to the lifted position, and the cover is pivotable with respect to the cross-member when the cover is in the lifted position.

20. A packaging machine comprising:

a chamber comprising a liftable, pivotable cover, the chamber being closed when the cover is in a lowered position and open when the cover is in a lifted position, the cover being liftable from the lowered position to the lifted position by a vertical translation movement, and the cover being pivotable in the lifted position;

wherein the packaging machine comprises a joint about which the cover is pivotable, and the packaging machine is structured and arranged as a chamber band machine having the cover and a band conveyor, in which the cover together with a part of the band conveyor form the chamber, and wherein the band conveyor is configured to convey packages in a transport direction, and the cover has a center of mass and is connected to the joint in such a manner that a rotation axis of the joint extends in the transport direction and through the center of mass of the cover.

* * * * *